US012025366B2

(12) United States Patent
Yoo et al.

(10) Patent No.: US 12,025,366 B2
(45) Date of Patent: Jul. 2, 2024

(54) REFRIGERATOR

(71) Applicant: LG ELECTRONICS INC., Seoul (KR)

(72) Inventors: Daehyun Yoo, Seoul (KR); Geonwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 75 days.

(21) Appl. No.: 17/791,094

(22) PCT Filed: Jan. 7, 2020

(86) PCT No.: PCT/KR2020/000295

§ 371 (c)(1),
(2) Date: Jul. 6, 2022

(87) PCT Pub. No.: WO2021/141155

PCT Pub. Date: Jul. 15, 2021

(65) Prior Publication Data

US 2023/0030975 A1 Feb. 2, 2023

(51) Int. Cl.
*F25D 23/06* (2006.01)

(52) U.S. Cl.
CPC ..... *F25D 23/062* (2013.01)

(58) Field of Classification Search
CPC .... F25D 23/062; F25D 23/065; F25D 23/066; F25D 23/028
See application file for complete search history.

(56) References Cited

U.S. PATENT DOCUMENTS 11,047,613 B1 * 6/2021 Park ..... F25D 23/028
11,650,004 B1 * 5/2023 Hunter ..... F25D 23/06 428/69
2011/0050066 A1 * 3/2011 Lee ..... F25D 23/028 312/404

(Continued)

FOREIGN PATENT DOCUMENTS

JP 2013-061133 A 4/2013
KR 10-2005-0075782 7/2005

(Continued)

OTHER PUBLICATIONS

English translation of KR20180106734 from espacenet (Year: 2023).*

(Continued)

*Primary Examiner* — Daniel J Rohrhoff
(74) *Attorney, Agent, or Firm* — KED & Associates LLP

(57) ABSTRACT

The present invention relates to a refrigerator. The present invention provides a refrigerator including: a cabinet provided with a storage space; and a door connected to the cabinet to open and close the storage space, wherein the door includes: a front panel made of a stone material; a door liner disposed on a rear surface of the front panel to define a foaming space together with the front panel; and an insulating material provided in the foaming space, wherein the door liner includes a panel coupling portion that is in contact with the rear surface of the front panel, and a guide groove into which at least a portion of the panel coupling portion is inserted is provided in the rear surface of the front panel.

18 Claims, 14 Drawing Sheets

(56) References Cited

U.S. PATENT DOCUMENTS

| | | | | |
|---|---|---|---|---|
| 2016/0258671 | A1* | 9/2016 | Allard | F25D 23/085 |
| 2017/0314844 | A1* | 11/2017 | Tsuruga | F25D 23/065 |
| 2018/0274852 | A1* | 9/2018 | Kang | F25D 23/025 |
| 2023/0036523 | A1* | 2/2023 | Yoo | F25D 23/10 |

FOREIGN PATENT DOCUMENTS

| | | | |
|---|---|---|---|
| KR | 10-2018-0105941 | A | 10/2018 |
| KR | 10-2018-0106734 | A | 10/2018 |
| KR | 10-2018-0106765 | | 10/2018 |
| KR | 10-2019-0106494 | A | 9/2019 |

OTHER PUBLICATIONS

U.S. Appl. No. 10/859,294, filed Dec. 8, 2020, Kim et al.
International Search Report (with English Translation) and Written Opinion dated Sep. 25, 2020 issued in Application No. PCT/KR2020/000295.

* cited by examiner (a)

(b)

REFRIGERATOR

CROSS-REFERENCE TO RELATED PATENT APPLICATIONS

This application is a U.S. National Stage Application under 35 U.S.C. § 371 of PCT Application No. PCT/KR2020/000295, filed Jan. 7, 2020, whose entire disclosure is hereby incorporated by reference.

TECHNICAL FIELD

The present invention relates to a refrigerator.

BACKGROUND ART

Generally, refrigerators are household appliances that are capable of storing objects such as foods at a low temperature in a storage space provided in a cabinet. Since the storage space is surrounded by heat insulation wall, the inside of the storage space may be maintained at a temperature less than an external temperature.

The storage space may be classified into a refrigerating compartment or a freezing compartment according to a temperature range of the storage space. In addition, the food may be stored in the refrigerating compartment or the freezing compartment according to the type or condition of the food.

The refrigerator may be provided as a built-in type together with other electronic devices in the kitchen. In this case, a design in outer appearance of the refrigerator is performed in harmony with the furniture in the kitchen.

In addition, in recent years, installation positions of the refrigerator have been diversified, such as placing the refrigerator in the living room or the room instead of the kitchen according to various needs of the user.

As the installation positions of the refrigerator are diversified, the design of the outer appearance of the refrigerator is performed so that the outer appearance of the refrigerator is harmonized with the furniture in a space in which the refrigerator is installed.

An assembly structure of a built-in refrigerator, which includes a furniture door body made of a wood material and a furniture door fixed to one side of the furniture door boy body and provided as a decoration portion made of a material other than wood is disclosed in Korean Patent Publication No. 10-2005-0075782 that is a prior art document.

In the case of this prior art document, the door body is made of the wood material, and thus, there is a problem that resistance to stains, scratches, chemical damage, and heat is not high.

In addition, in the case of the prior art document, there are problems that deformation occurs when contents are stained on the exterior including the door of the refrigerator in a process of taking out the contents from the inside of the refrigerator, and deformation occurs due to external stimuli.

DISCLOSURE OF THE INVENTION

Technical Problem

An object of the present invention is to provide a refrigerator in which a cabinet cover made of a stone material and a front panel of a door form an outer appearance thereof.

In addition, an object of the present invention is to provide a refrigerator in which an upper cabinet cover is detachable to continuously manage products.

In addition, an object of the present invention is to provide a refrigerator, which is capable of preventing efficiency of the refrigerator from being deteriorated due to other objects disposed on a rear surface of the refrigerator.

Technical Solution

A refrigerator of the present invention for solving the above problems may minimize processing of a front panel and a cabinet cover, which are made of a stone material to form an outer appearance of a stone material, which is difficult to be processed, but has high durability and resistance to breakage and also may secure coupling force between components.

For example, the front panel made of the stone material and a door liner disposed on a rear surface of the front panel may not be screw-coupled, but be coupled by a foaming liquid injected into a foaming space formed by the front panel and the door liner.

A refrigerator according to an embodiment of the present invention includes: a cabinet provided with a storage space; and a door connected to the cabinet to open and close the storage space, wherein the door includes: a front panel made of a stone material; a door liner disposed on a rear surface of the front panel to define a foaming space together with the front panel; and an insulating material provided in the foaming space, wherein the door liner includes a panel coupling portion that is in contact with the rear surface of the front panel, and a guide groove into which at least a portion of the panel coupling portion is inserted is provided in the rear surface of the front panel.

The panel coupling portion may include an insertion portion extending toward the front panel, wherein the insertion portion may be inserted into the guide groove.

The door liner may further include a fixing portion that is in contact with at least a portion of a circumference of the front panel.

The fixing portion may be in contact with a bottom surface of the front panel.

The door liner may further include a cabinet insertion portion protruding from the panel coupling portion in a direction that is away from the front panel, and the fixing portion may extend from one surface of the cabinet insertion portion toward the front panel.

The cabinet may include: an inner case configured to define the storage space; a pair of side panels disposed at both sides of the inner case; a middle plate disposed between the pair of side panels to define a foaming space together with the inner case; and a cabinet cover seated on a top surface of the middle plate.

A plurality of cabinet fixing portions may be provided on a bottom surface of the cabinet cover, and a cover fixing hole defined at a position corresponding to the cabinet fixing portion may be provided in an upper plate configured to define the top surface of the middle plate.

The cabinet fixing portion may include: a first portion inserted into the cabinet cover; and a second portion connected to the first portion and having a diameter greater than that of the first portion.

The cover fixing hole may include: a first hole having a diameter equal to or greater than that of the second portion of the cabinet fixing portion; and a second hole extending from the first hole and having a diameter less than that of the first hole.

The second hole may have a size less than that of the second portion and greater than that of the first portion.

The cabinet may further include a fixing cover coupled to a bottom surface of the middle plate and configured to surround the cover fixing hole.

The fixing cover may include: a cover recess portion spaced apart from the cover fixing hole and disposed on the bottom surface of the middle plate; and a coupling portion configured to connect the cover recess portion to the middle plate so as to be in contact with the bottom surface of the middle plate.

The middle plate may include a plurality of guide portions disposed to be spaced apart from each other on at least one surface of the cover fixing hole and recessed toward a lower side of the middle plate, and the coupling portion may be disposed between the guide groove and the cover fixing hole.

The cabinet may include: a rear panel comprising an external air suction hole through which external air is suctioned; and a rear cover configured to surround the external air suction hole and comprising a plurality of holes.

The rear cover may include a cover plate spaced parallel to the rear panel, and a plurality of holes may be provided at a position corresponding to the external air suction hole of the cover plate.

The rear cover may further include a side surface portion configured to connect the cover plate to the rear panel, and a plurality of holes may be provided in the side surface portion.

The cabinet may further include a base configured to define an outer appearance of a lower portion thereof and comprising a protrusion protruding from a rear surface thereof, and the rear cover may be seated on a top surface of the protrusion.

Advantageous Effects

According to the proposed invention, since the cabinet cover made of the stone material forms the outer appearance of the cabinet, there may be the advantage in that the aesthetics of the refrigerator is improved.

In addition, since the cabinet cover is replaced, there may be the advantage that the outer appearance of the refrigerator is produced in various designs.

In addition, according to the present invention, the surface durability is reinforced compared to the wood material, there may be the advantage that prevents the deformation of the outer appearance.

In addition, according to the present invention, there may be the advantage that the outer appearance is kept neat due to the high resistance to the stains, the scratches, the chemical damage, and the heat.

In addition, according to the present invention, there may be the advantage in that the insulating material between the outer case and the inner case of the refrigerator is prevented from leaking to the outside of the inner case.

In addition, according to the present invention, there may be the advantage in that the efficiency of the refrigerator is prevented from being deteriorated by the object disposed at the rear surface of the refrigerator.

MODE FOR CARRYING OUT THE INVENTION

Reference will now be made in detail to the embodiments of the present invention, examples of which are illustrated in the accompanying drawings.

Figure 1:
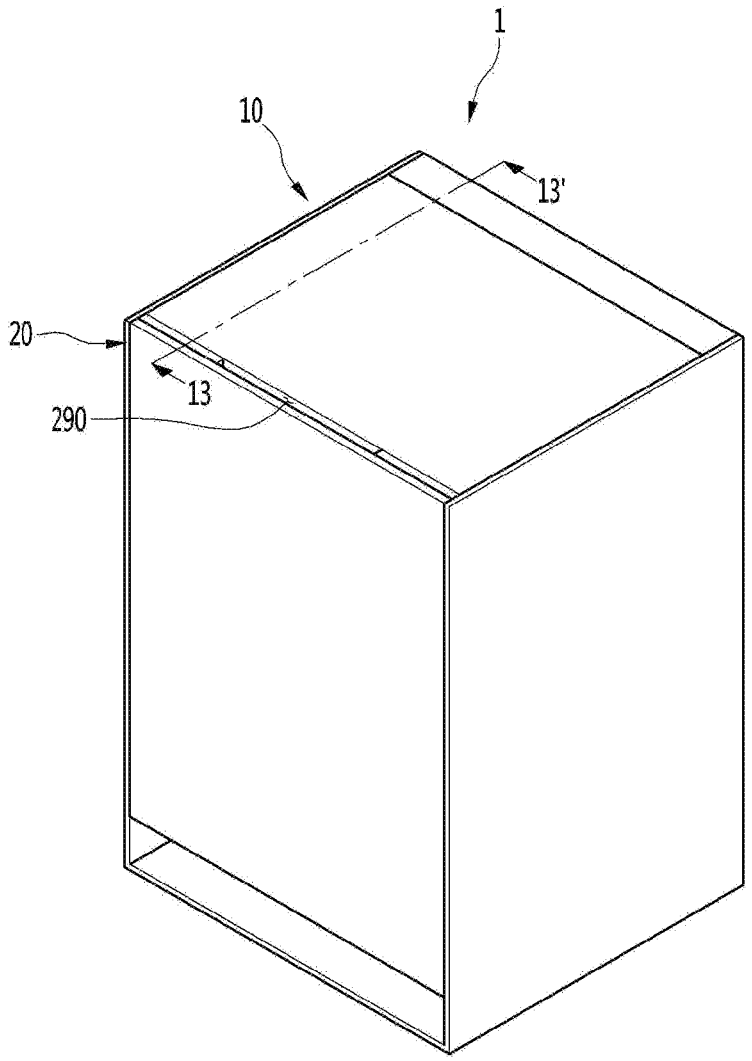
FIG. 1 is a perspective view of a refrigerator according to an embodiment.
Figure 2:
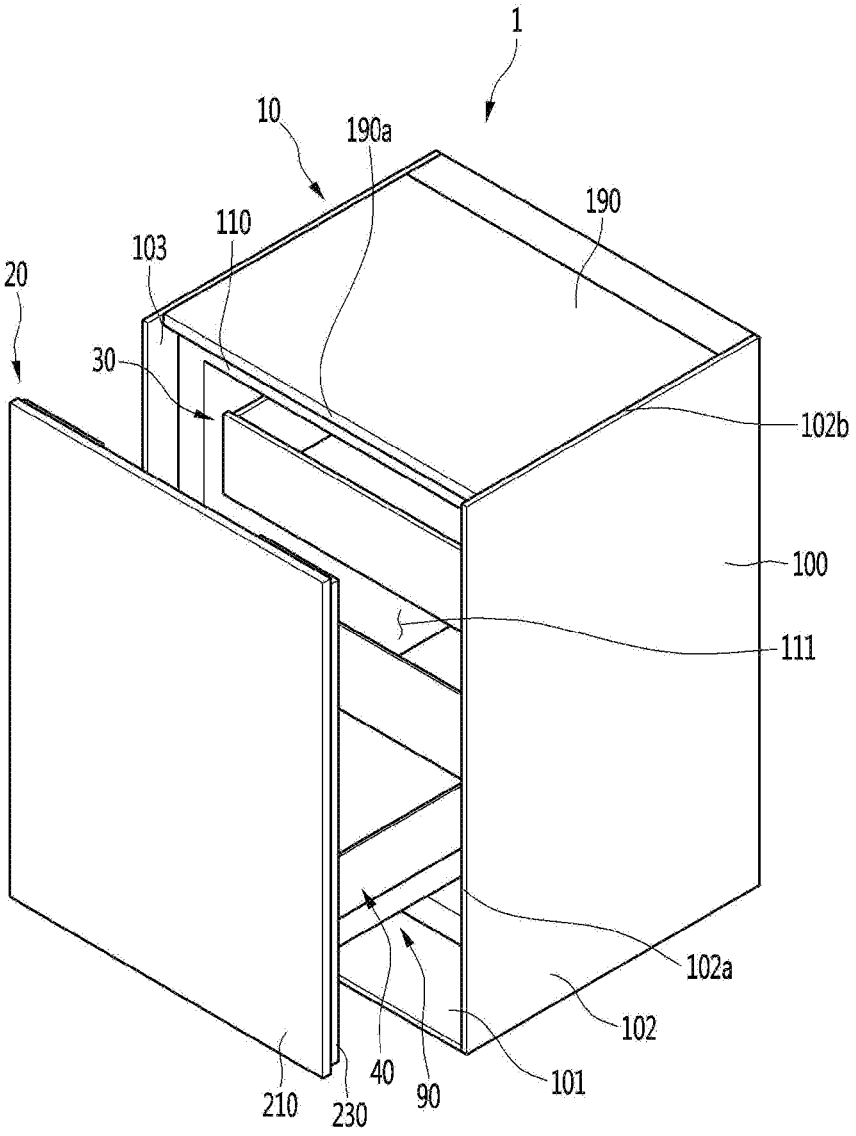
FIG. 2 is a perspective view illustrating a state in which a door is opened in FIG. 1.
Figure 3:
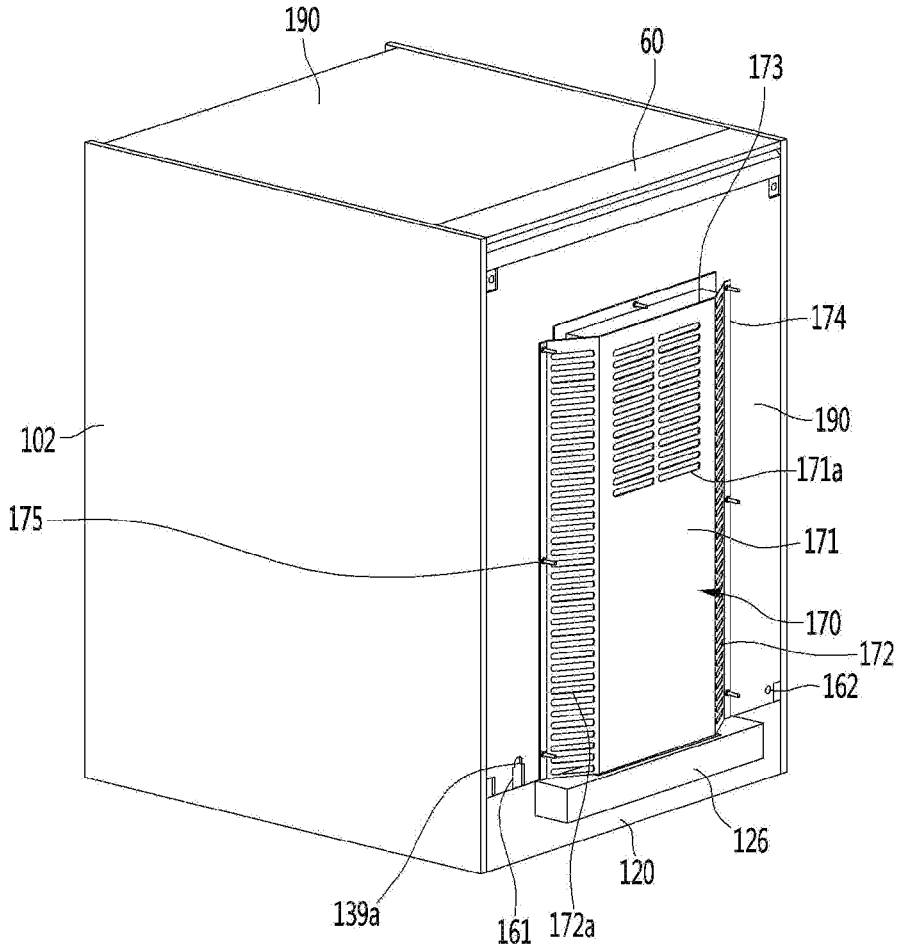
FIG. 3 is a perspective view illustrating a rear surface of the refrigerator of FIG. 1.
Figure 4:
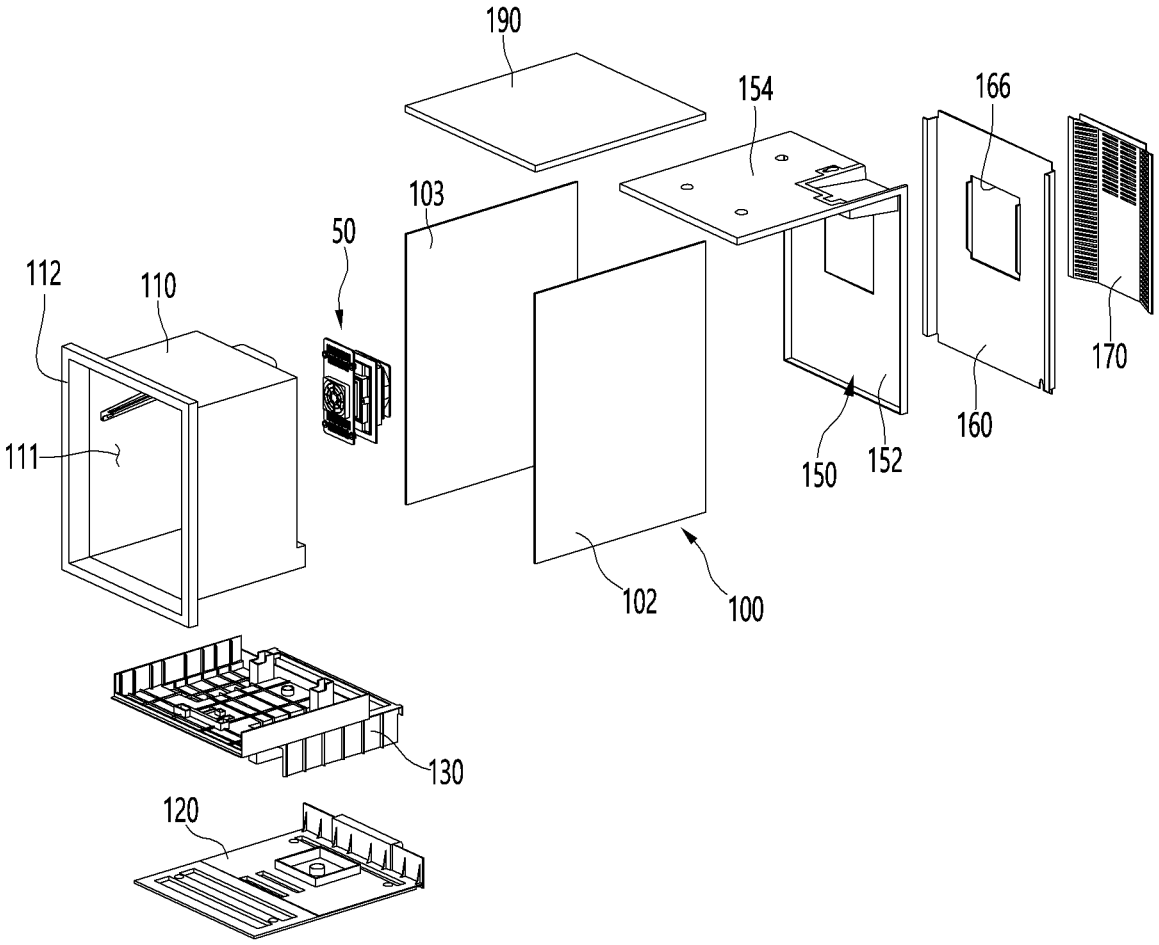
FIG. 4 is an exploded perspective view of a cabinet according to an embodiment of the present invention.

FIG. 1 is a perspective view of a refrigerator according to an embodiment, FIG. 2 is a perspective view illustrating a state in which a door is opened in FIG. 1, FIG. 3 is a perspective view illustrating a rear surface of the refrigerator of FIG. 1, and FIG. 4 is an exploded perspective view of a cabinet according to an embodiment of the present invention.

Referring to FIGS. 1 to 4, a refrigerator 1 according to an embodiment of the present invention may include a cabinet 10 provided with a storage space 111 and a door 20 connected to the cabinet 10 to open and close the storage space 111.

The cabinet 10 may include an inner case 110 defining the storage space 111, an outer case 100 surrounding the inner case 110, and a cabinet cover 190.

A portion of the outer case 100 may be made of a metal material. For example, outer case 100 may be made of an aluminum (Al) material. The outer case 100 may be formed by being bent at least twice or bent. Alternatively, the outer case 100 may be formed by bonding a plurality of metal plates.

For example, the outer case 100 may include, for example, a pair of side panels 102 and 103. The pair of side panels 102 and 103 may define an outer appearance of a side surface of the refrigerator 1.

The inner case 110 may be directly or indirectly fixed to the outer case 100 in a state of being disposed between the pair of side panels 102 and 103.

A front end 102*a* of each of the pair of side panels 102 and 103 may be disposed in front of the front surface of the inner case 110, rather than a front surface of the inner case 110.

A horizontal width of the door 20 may be equal to or less than a distance between the pair of side panels 102 and 103.

Thus, a space in which the door 20 is disposed may be defined between the pair of side panels 102 and 103.

For example, in a state in which the door 20 closes the storage space 111, the door 20 may be disposed between the pair of side panels 102 and 103.

Here, in a state in which the door 20 closes the storage space 111, the front surface of the door 20 may be disposed on the same plane as a front end 102*a* of each of the side panels 102 and 103 so that the outer appearances of the door 20 and the cabinet 10 have a sense of unity.

That is, the front surface of the door 20 and the front end 102*a* of each of the side panels 102 and 103 may define the outer appearance of the front surface of the refrigerator 1.

In addition, the outer case 100 may further include a rear panel 160 defining an outer appearance of a rear surface of the refrigerator 1.

Thus, the outer appearance of the refrigerator 1 excluding the door 20 may be defined by the side panels 102 and 103, the cabinet cover 190 and the rear panel 160.

The cabinet 10 may further include a case supporter 130 supporting the inner case 110 and a base 120 coupled to a lower side of the case supporter 130.

The cabinet 10 may further include a middle plate 150 defining a foaming space 159 (see FIG. 13) together with the inner case 110. The middle plate 150 may cover upper and rear sides of the inner case 110 at a position that is spaced apart from the inner case 110.

The cabinet 10 may further include a cooling device 50 cooling the storage space 111. The door 20 may be connected to, for example, the cabinet 10 by a rail assembly 90.

Thus, the door 20 may open and close the storage space 111 while moving in a forward and backward sliding manner in a state of being connected to the cabinet 10.

According to the present invention, even when the refrigerator 1 is disposed in a narrow space such as a kitchen, living room, or room, since the door 20 opens and closes the storage space 111 in the sliding manner, the door 20 may be opened without interfering with surrounding structures.

One side of the rail assembly 90 may be connected to the door 20, and the other side may be connected to the inner case 110.

The door 20 may include a front panel 210 made of a stone material and a door liner 230 coupled to a rear surface of the front panel 210.

The front panel 210 and the door liner 230 may define a foaming space, and as a foaming liquid is filled in the foaming space, an insulating material 240 (see FIG. 8) may be provided between the front panel 210 and the door liner 230.

In order to open the door 20, the door 20 may define a space 290 for a handle into which a user's hand is inserted so that the user holds the door 20.

The space 290 for the handle may be defined, for example, as a portion of an upper portion of the door liner 230 is recessed downward.

The space 290 for the handle may be disposed between the front panel 210 and the cabinet 10 in a state in which the door 20 closes the storage space 111. Thus, the user may open the door 20 by pulling the door 20 after inserting the hand into the space 290 for the handle in the state in which the door 20 closes the storage space 111.

According to the present invention, since a structure such as the handle does not protrude to the outside in the state in which the door 20 is closed, the aesthetics of the refrigerator 1 may be improved.

A height of the refrigerator 1 is not limited, but may be less than that of a general adult. As a capacity of the refrigerator 1 decreases, the height of the refrigerator 1 may decrease.

As in the present invention, when the space 290 for the handle exists above the door 20, even if the height of the refrigerator 1 decreases, the user may easily open the door 20 in a standing or sit state.

The upper end of each of the pair of side panels 102 and 103 may be disposed higher than an upper end of the inner case 110.

Thus, a space may be defined above the inner case 110, and a cabinet cover 190 may be disposed in the space. The cabinet cover 190 may define an outer appearance of a top surface of the cabinet 10. That is, the cabinet cover 190 defines the outer appearance of the top surface of the refrigerator 1.

The cabinet cover 190 may be directly fixed to the inner case 110 or fixed to the middle plate 150 surrounding the inner case 110.

In a state in which the cabinet cover 190 covers the inner case 110, the cabinet cover 190 may be disposed between the pair of side panels 102 and 103.

A top surface of the cabinet cover 190 may be disposed on the same plane or at the same height as the upper end 102*b* of each of the side panels 102 and 103 so that the outer appearances of the cabinet cover 190 and the cabinet 10 have a sense of unity.

The cabinet cover 190 may be made of, for example, a stone material.

According to the present invention, since each of the front panel 210 and the cabinet cover 190 of the door 20 is made of the stone material, in the state in which the door 20 is closed, there is an advantage in that there is a uniformity in material between the door 20 and the cabinet cover 190 to improve aesthetics.

Furthermore, when the height of the refrigerator is low, the user may visually check the cabinet cover 190. Thus, since the cabinet cover 190 is made of the stone material, there may be an advantage of enhancing surface durability as well as providing basic aesthetic feeling.

The refrigerator 1 of the present invention may be used, for example, as a side table refrigerator.

The side table refrigerator may serve as a side table in addition to a function of storing food. Unlike the general refrigerator that is often provided in the kitchen, the side table refrigerator may be used next to the bed in the bedroom.

For the convenience of the user, a height of the side table refrigerator may be preferably similar to that of the bed, for example, and may be formed to have a height less than that of the general refrigerator and to be compact.

The front surface 190*a* of the cabinet cover 190 may be disposed in front of the front surface of the inner case 110. Thus, in the state in which the door 20 closes the storage space 111, the cabinet cover 190 may cover a portion of the door liner 230 from the upper side.

The refrigerator 1 may further include one or more drawer assemblies 30 and 40 accommodated in the storage space 111.

A plurality of drawer assemblies 30 and 40 may be provided in the storage space 111 in order to improve efficiency of the storage space.

Some of the plurality of drawer assemblies 30 and 40 may exist in a fixed position in the storage space 111 or may be connected to a rail and slidably disposed by the rail.

Alternatively, some of the plurality of drawer assemblies 30 and 40 may be connected to the door 20 so as to be slidably inserted and withdrawn together with the door 20.

Alternatively, some of the plurality of drawer assemblies 30 and 40 may be configured to be slidably withdrawn together with the door 20 at an initial stage of opening during the process of opening the door 20 and also to be stopped at a position that is withdrawn by a predetermined distance.

In addition, a display unit 60 may be installed at a rear side of an upper end of the cabinet 10 and may be disposed at a rear side of the cabinet cover 190.

According to the present invention, since the display unit 60 is disposed above the cabinet 10, even if the height of the refrigerator 1 is low, the user may easily see the display panel 60.

Hereinafter, a structure of the cabinet 10 will be described in detail.

Referring to FIGS. 3 and 4, the cabinet 10 may further include a rear cover 170 coupled to a rear surface of the rear panel 160.

The rear panel 160 may be coupled to the case supporter 130 at the rear side of the rear plate 152 (see FIG. 4) of the middle plate 150 in a state of being spaced apart from the rear plate 152.

The case supporter 130 may be provided with a panel support protrusion 139*a* for supporting the rear panel 160. A protrusion accommodation groove 161 for receiving the panel supporting protrusion 139*a* may be defined in the rear panel 160.

In addition, a first coupling hole 162 that is bolt-coupled to the case supporter 130 and a second coupling hole that is bolt-coupled to the rear cover 170 may be defined in the rear panel 160.

Also, an external air suction hole 166 through which air from outside of the refrigerator 1 is introduced may be defined in the rear panel 160 to cool a cooling device 50.

Here, the cooling device 50 may be exposed through the external air suction hole 166 to impair an aesthetic sense, and when an object such as a curtain is disposed at a rear side of the refrigerator 1, there is a problem in that suction of air into the cooling device 50 is obstructed.

Thus, the rear cover 170 may protrude backward than the rear panel 160.

In detail, the rear cover 170 may include a cover plate 171 spaced apart from the rear panel 160 in parallel, a side portion 172 connecting the cover plate 171 to the rear panel 160, and a top surface portion 173.

At least a portion of the cover plate 171 may include a plurality of holes 171*a* through which external air is introduced The plurality of holes 171*a* may be provided in the form of a grill and may be formed to correspond to a position of the external air suction hole 166.

That is, the plurality of holes 171*a* may be defined only in a portion of the upper side of the cover plate 171.

In addition, a plurality of grill-shaped holes 172*a* may also be defined in the side portion 172. As a result, it is possible to prevent an inflow of air from being deteriorated without blocking the suction of the external air by an object disposed at the rear of the refrigerator.

In detail, the side portion 172 may be coupled to the rear panel 160 while being connected to the cover plate 171 to form an inclination. In addition, the plurality of grill-shaped holes 172*a* may be defined over an entire area of the side portion 172.

For example, the rear cover 170 may be provided in a hexahedral shape having an opened bottom and front surfaces. Also, the front surface of the rear cover 170 is in contact with the rear panel 160, and the bottom surface may be in contact with the protrusion 126 (see FIG. 3) of the base 120.

In detail, the rear cover 170 may include a coupling portion 174 bent to extend from the side portion 172 and the top surface portion 173 and may be coupled to the rear panel 160 through a coupling hole 175 defined in the coupling portion 174.

For example, the coupling hole 175 and the second coupling hole of the rear panel 160 may be connected to each other by a bolt.

In addition, the protrusion 126 may be configured to form a predetermined distance from a wall on which the refrigerator 1 is installed and to serve as a handle when the refrigerator 1 moves, and may protrude from the rear surface of the base 120.

Here, the rear cover 170 may be seated on a top surface of the protrusion 126, and an object behind the refrigerator 1 may be prevented from affecting suction of air outside the refrigerator 1 through the protrusion 126 and the rear cover 170.

Hereinafter, the door 20 according to this embodiment will be described in detail.

Figure 5:
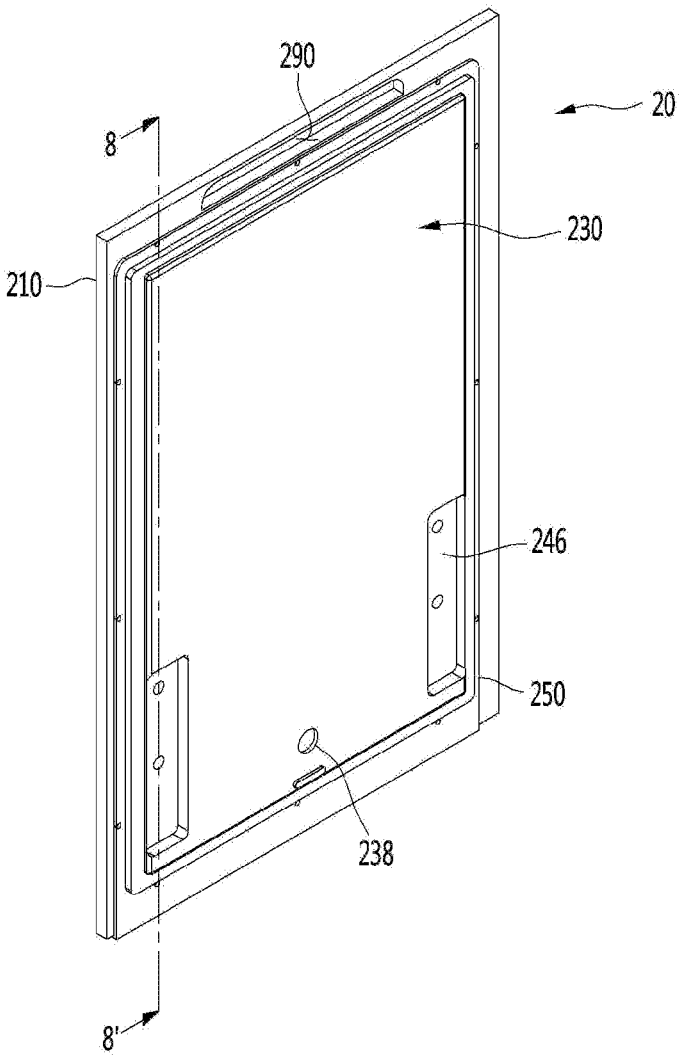
FIG. 5 is an inner perspective view of a door according to an embodiment of the present invention.
Figure 6:
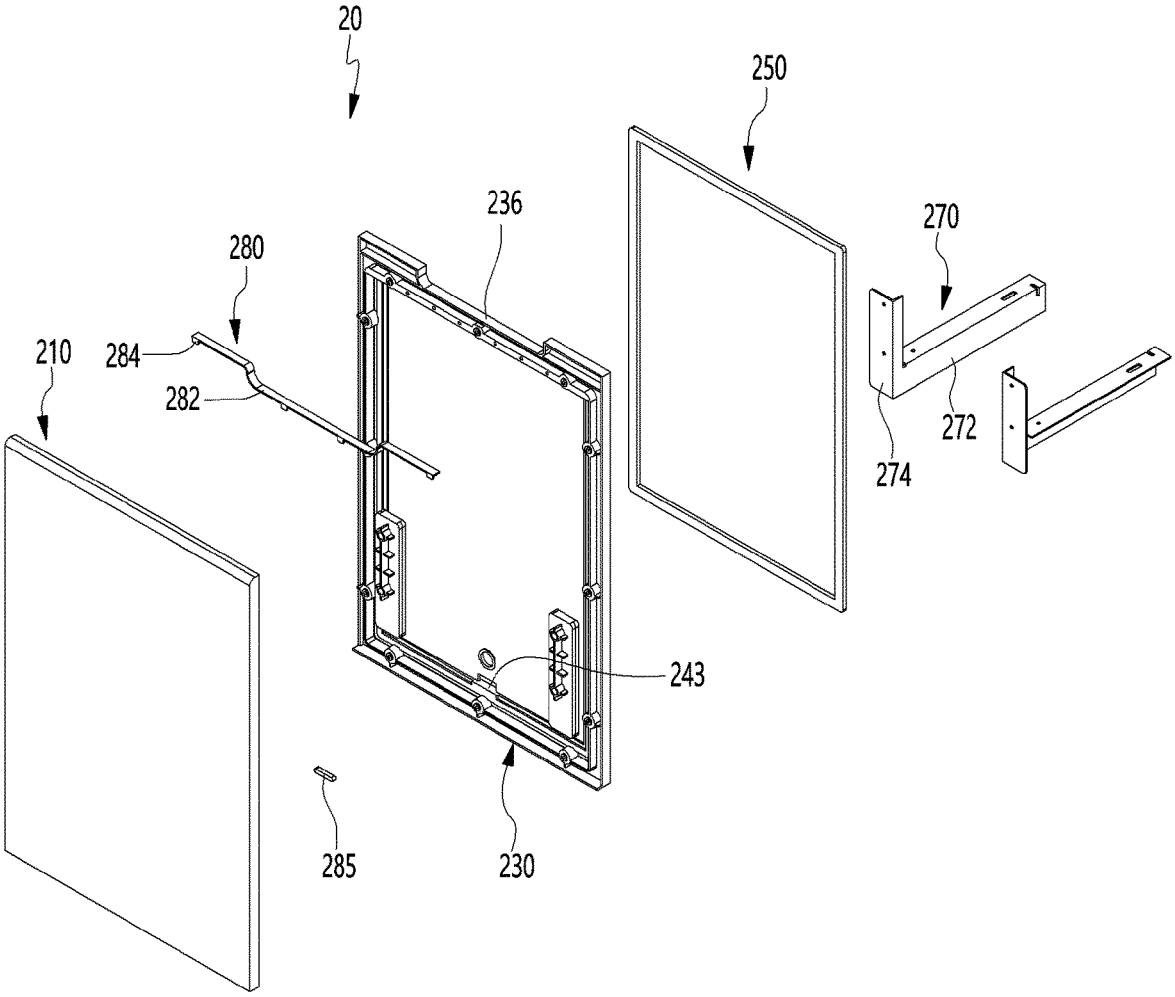
FIGS. 6 and 7 are exploded perspective views of the door according to an embodiment of the present invention.
Figure 7:
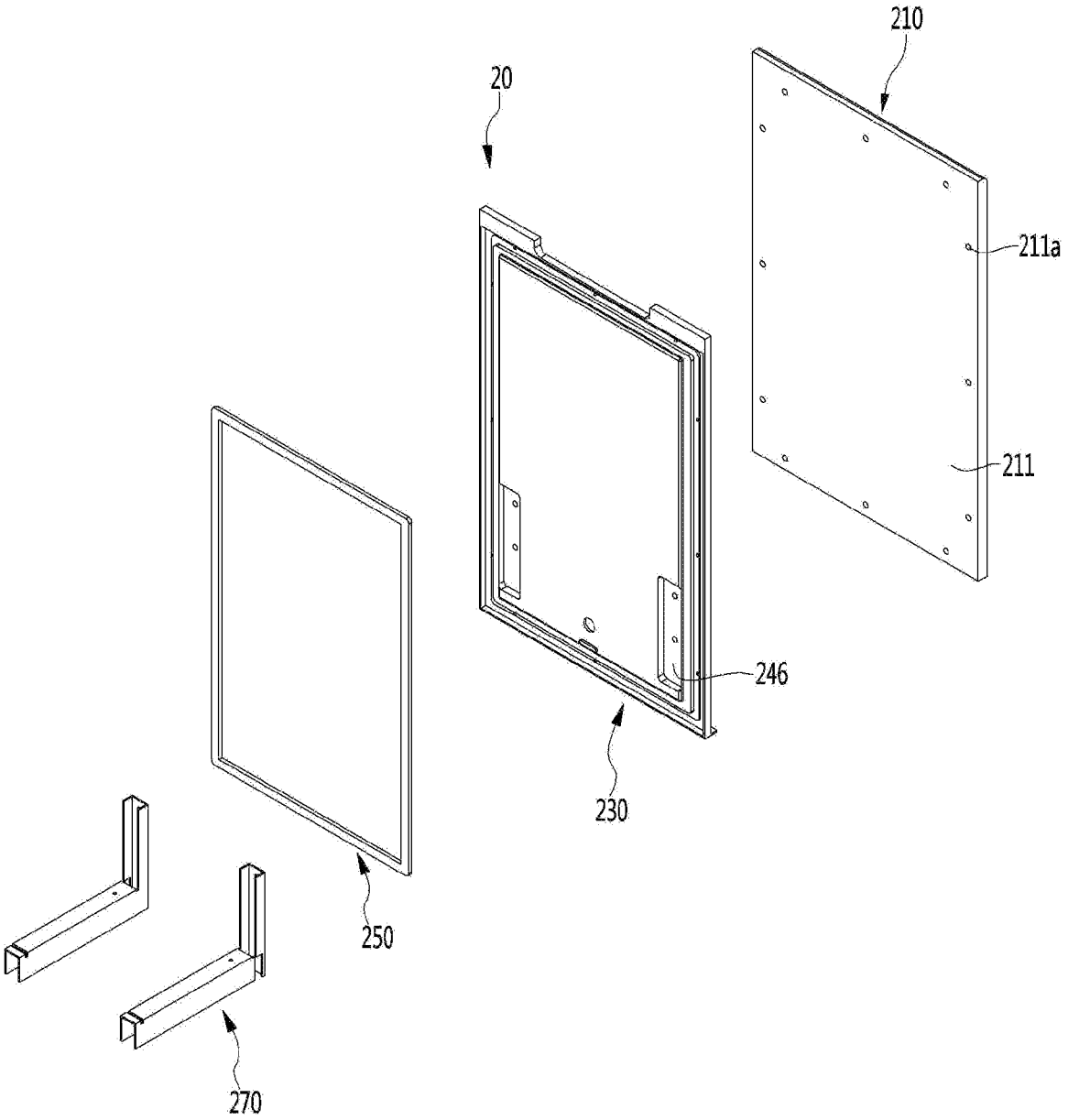
Figure 8:
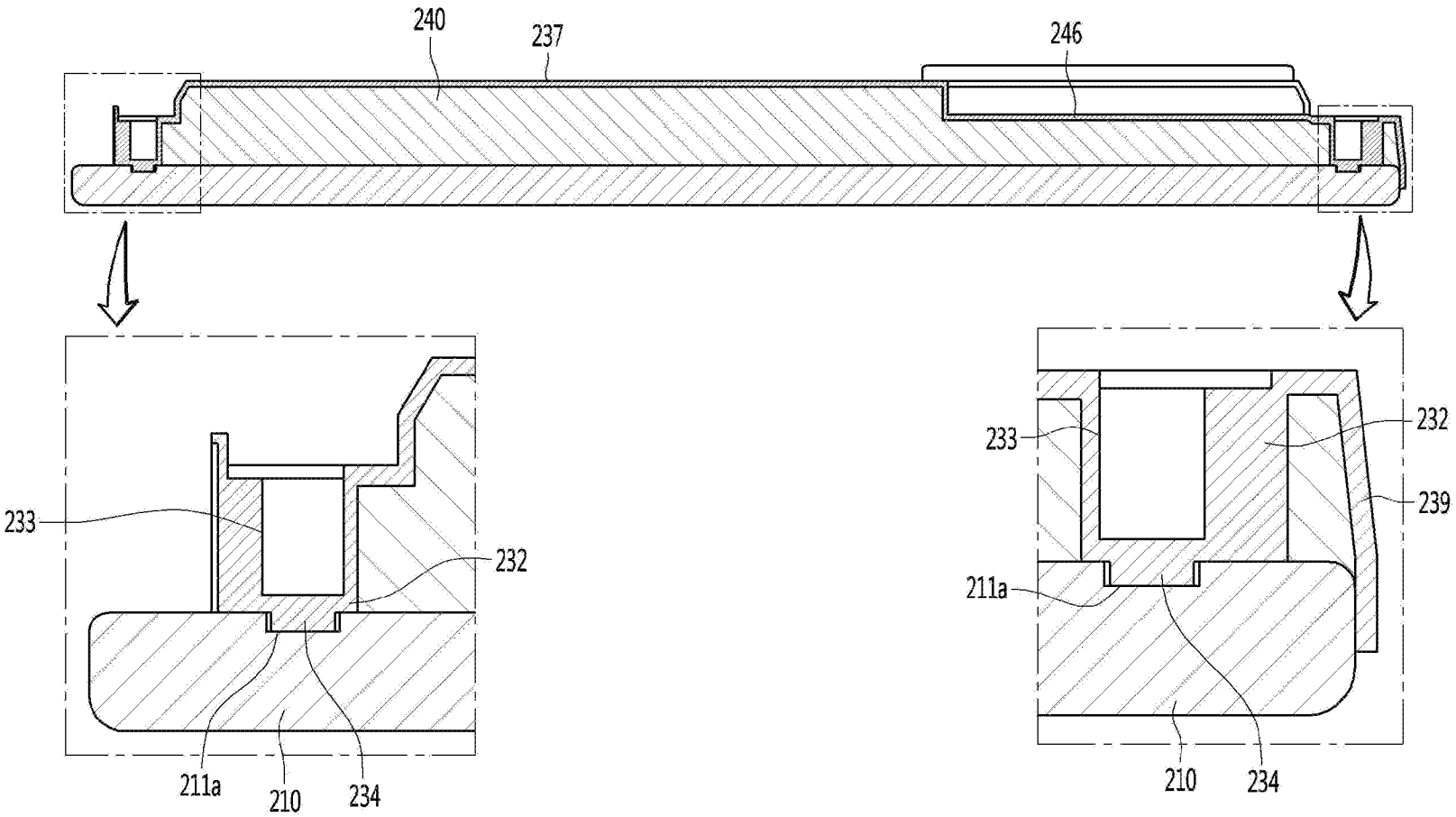
FIG. 8 is a cross-sectional view taken along the line 8-8' of FIG. 5.

FIG. 5 is an inner perspective view of the door according to an embodiment of the present invention, FIGS. 6 and 7 are exploded perspective views of the door according to an embodiment of the present invention, and FIG. 8 is a cross-sectional view taken along the line 8-8' of FIG. 5.

Referring to FIGS. 5 to 8, the door 20 according to this embodiment may include a front panel 210 forming an outer appearance of a front surface and a door liner 230 fixed to a rear surface 211 of the front panel 210.

In the present invention, a surface that is seen when the door 20 is viewed from the front of the refrigerator 1 is a front surface of the front panel 210, and an opposite surface of the refrigerator 1 is a rear surface 211.

In addition, the door 20 may further include a gasket 250 that is fixed to the door liner 230 to prevent cold air of the storage space 111 from leaking in a state in which the door 20 closes the storage space 111.

The front panel 210 may be made of a stone material as described above.

Each of a horizontal length and vertical length of the front panel 210 may be greater than each of a vertical length and horizontal length of the door liner 230.

The door liner 230 may be prevented from interfering with each of the side panels 102 and 103 while the door 20 is closed due to a difference in size between the front panel 210 and the door liner 230.

In a state in which the door liner 230 is fixed to a rear surface 211 of the front panel 210, the rear surface 211 of the front panel 210 and a portion of a surface of the door liner 230 form a foaming space. Since a foaming liquid is filled into the foaming space, an insulating material 240 is provided in the door 20.

That is, the insulating material 240 is in contact with the rear surface 211 of the front panel 210 and a portion of the surface of the door liner 230.

In addition, a plurality of guide grooves 211*a* for guiding a position of the door liner 230 may be defined in the rear surface 211 of the front panel 210.

The door liner 230 may include a panel coupling portion 232 to be coupled to the front panel 210.

The panel coupling portion 232 may be formed in a rectangular frame shape. The panel coupling portion 232 may be in contact with the rear surface 211 of the front panel 210.

In detail, the panel coupling portion 232 may include an insertion portion 234 extending toward the front panel 210.

The insertion portion 234 may be inserted into the guide groove 211*a* and may correspond to a size of the guide groove 211*a*.

That is, a diameter of the guide groove 211*a* and a diameter of the insertion portion 234 may be the same.

A plurality of recessed portions 233 may be provided at positions corresponding to the guide grooves 211*a* of the front panel 210.

In detail, each of the recessed portions 233 may be recessed toward the rear surface 211 of the front panel 210 from the panel coupling portion 232. A portion of the gasket 250 to be described later may be inserted into the recessed portion 233 and then coupled to the recessed portion 233.

Also, a diameter of the insertion portion 234 may be less than the diameter of the recessed portion 233.

In addition, a fixing portion 239 surrounding a portion of a circumference of the front panel 210 may be further included at one side of the panel coupling portion 232.

In detail, the fixing portion 239 may extend from one side of the panel coupling portion 232 toward the front panel 210.

For example, the fixing portion 239 may be disposed below the panel coupling portion 232 to cover a portion of a bottom surface of the front panel 210. Thus, it is possible to guide the position of the door liner 230 together with the guide groove 211*a*.

Also, the fixing portion 239 may extend toward the front surface of the front panel 210 to a depth greater than that of the guide groove 211*a*. That is, a distance from a front surface of the front panel 210 to the guide groove 211*a* may be greater than a distance up to one end of the fixing portion 239.

The fixing portion 239 may also serve to support a load of the front panel 210 in a state in which the front panel 210 and the door liner 230 are coupled.

On the other hand, the insertion portion 234 may be simply inserted into the guide groove 211*a*. For another example, the insertion portion 234 may adhere to a portion that is in contact with the guide grove 211*a* by an adhesive means such as an adhesive.

The door liner 230 may further include a cabinet inlet 237 protruding from the panel coupling portion 232 in a direction that is away from the front panel 210.

The cabinet inlet 237 may be accommodated into the storage space 111 in a state in which the door 20 closes the storage space 111. That is, the cabinet inlet 237 is inserted into the inner case 110.

A thickness of the insulating material 240 that is in contact with the cabinet inlet 237 may increase by the cabinet inlet 237.

Therefore, according to the present invention, the cold air of the storage space 111 may be prevented from leaking to the outside by the cabinet inlet 237 itself, and there is an advantage in that insulation performance is improved by increasing in thickness of the insulating material 240.

Since a portion of the cabinet inlet 237 is inserted into the storage space 111, a portion of the insulating material 240 may also be inserted into the storage space 111.

An injection hole 238 for injecting the foaming liquid into the foaming space defined by the door liner 230 and the front panel 210 may be defined in the cabinet inlet 237. The injection hole 238 may be blocked by a packing that is not shown.

The door 20 may further include a support frame 270 for supporting a lower drawer assembly 40 among a plurality of drawer assemblies 30 and 40.

Specifically, the plurality of support frames 270 may be coupled to the door liner 230 in a state of being spaced apart from each other in the horizontal direction. For example, a pair of support frames 270 is illustrated in FIG. 6.

The support frames 270 may include a horizontal frame 272 extending forward and backward and a vertical frame 274 extending upward from a front end of the horizontal frame 272.

The vertical frame 274 may be coupled to the door liner 230. Here, the door liner 230 is provided with a plurality of frame accommodation portions 246 in which the vertical frame 274 is accommodated so that the thickness of the door 20 is prevented from increasing by the vertical frame 274.

For example, the frame accommodation portion 246 may be formed in the cabinet inlet 237. The frame accommodation portion 246 may be formed as a portion of the cabinet inlet 237 is recessed toward the front panel 210.

In the state in which the vertical frame 274 is accommodated in the frame accommodation portion 246, the vertical frame 274 may be coupled to the door liner 230 by a screw.

In order to improve coupling force between the door liner 230 and the vertical frame 274, a coupling protrusion to which the screw is coupled may be formed in the frame accommodation portion 246.

The coupling protrusion may protrude from the frame accommodation portion 246 toward the front panel 210.

The lower drawer assembly 40 may be seated on each of the horizontal frames 272. For this, an interval between the horizontal frames 272 may be less than a width of the lower drawer assembly 40. Each of the horizontal frames 272 may be fixed to the rail assembly 90.

According to the present invention, since the lower drawer assembly 40 is seated on each of the horizontal frames 272, the lower drawer assembly 40 may be withdrawn together while the door 20 is inserted and withdrawn.

The door liner 230 may further include a first magnet accommodation portion 243 in which a first magnet 285 is accommodated.

The first magnet accommodation portion 243 may be formed in the cabinet inlet 237. The first magnet accommodation portion 243 may be formed as a portion of the cabinet inlet 237 is recessed in a direction that is away from the front panel 210. Thus, the first magnet accommodation portion 243 may protrude from the cabinet inlet 237.

A handle recessed portion 236 that is recessed downward to define a space 290 for the handle is formed in the top surface of the door liner 230. The handle recessed portion 236 may be substantially formed as an outer edge of the door liner 230 is recessed.

A door decoration member 280 may be coupled to an upper side of the door liner 230. The door decoration member 280 may have the same shape as the top surface of the door liner 230. That is, the door decoration member 280 includes a round portion 282 having a shape corresponding to the handle recessed portion 236.

A space defined by the round portion 282 in the door decoration member 280 is substantially the space 290 for the handle.

A fixing rib 284 that is fixed to the door liner 230 is formed on the door decoration member 280. The fixing rib 284 may extend downward from a front end of the door decoration member 280. A rib groove into which the fixing rib 284 is inserted may be defined in the top surface of the door liner 230.

Of course, the door decoration member 280 may be omitted, and in this case, a space defined by the handle recessed portion 236 of the door liner 230 becomes the space 290 for the handle.

The inner case 110 may further include a front frame 112 extending vertically along a circumference of the inner case 110 from an entrance side of the storage space 111. Thus, when the door 20 closes the storage space 111, the gasket 250 of the door 20 may be in contact with the front surface of the front frame 112.

Since the gasket 250 is coupled to the door liner 230, a rear surface 211 of the front panel 210 is spaced apart from the front frame 112 in the state in which the door 20 closes the storage space 111.

In this case, a front surface of the cabinet cover 190 may be disposed closer to the front panel 210 than the front frame 112 to prevent the gasket 250 from being exposed to an upper side of the refrigerator 1.

That is, the front surface of the cabinet cover 190 is disposed in front of the front frame 112. The cabinet cover 190 covers an upper side of the gasket 250 from an upper side of the gasket 250.

Even when the front surface of the cabinet cover 190 is disposed in front of the front frame 112, the door 20 may be opened by the space 290 for the handle.

An assembly process of the door 20 will be described based on the structure of the door 20 as follows.

When the front panel 210 is made of a stone material, aesthetics and durability may be improved, and it has a strong advantage against external stimuli such as scratches and stains, but has a problem in that it is difficult to process compared to wood or metal materials.

Thus, it is preferable to assemble the front panel 210 and the door liner 230 while minimizing the processing of the front panel 210 made of the stone material.

In detail, the coupling structure between the front panel 210 and the door liner 230 may be deleted, and the foaming liquid may be injected through the injection hole 238 in a state in which the door liner 230 is temporarily fixed to the front panel 210.

The foaming liquid may be introduced into the foaming space defined by the door liner 230 and the front panel 210 so that the door liner 230 and the front panel 210 are coupled to each other while the foaming liquid is evenly distributed over the entire foaming space and then solidified.

That is, the foaming liquid may be disposed between an inner surface of the door liner 230 facing the front panel 210 and the rear surface 211 of the front panel 210 to fix the door liner 230 and the front panel 210.

Here, an insertion portion 234 of the door liner 230 may be inserted into the guide groove 211*a* of the front panel 210 to guide the fixing and position between the door liner 230 and the front panel 210.

In addition, as the insertion portion 234 is inserted into the guide groove 211*a*, there is no gap between the door liner 230 and the front panel 210, thereby preventing the foaming liquid from leaking to the outside.

Figure 9:
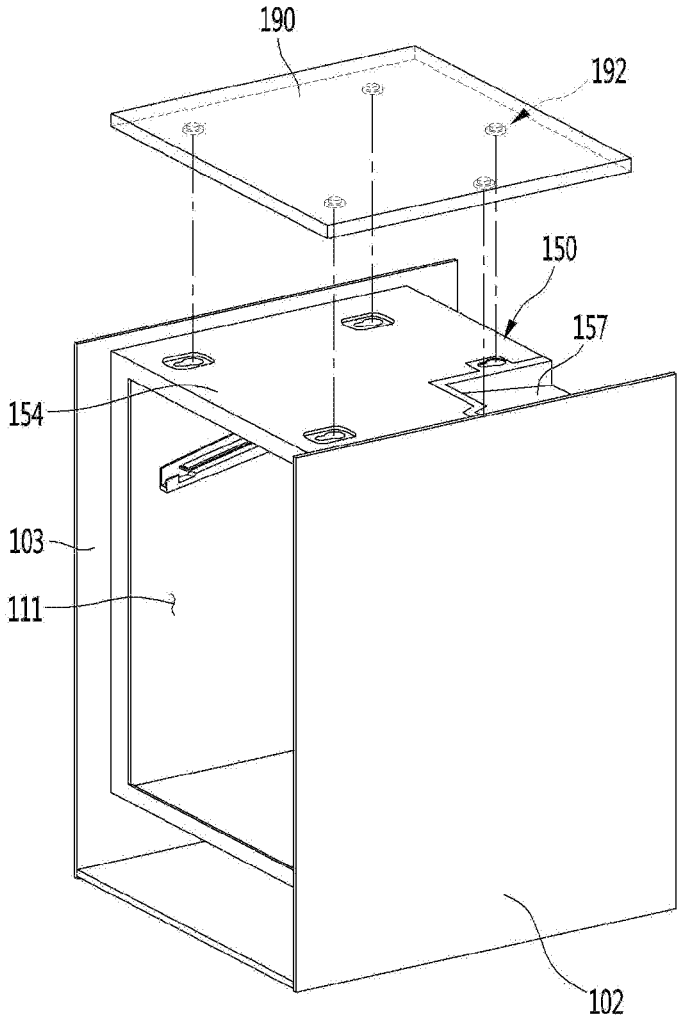
FIG. 9 is a perspective view of the cabinet according to an embodiment of the present invention.

FIG. 9 is a perspective view of the cabinet according to an embodiment of the present invention.

Referring to FIGS. 4 and 9, the middle plate 150 may cover the inner case 110 from the rear side of the inner case 110.

The middle plate 150 may include a rear plate 152 covering a rear surface of the inner case 110 and an upper plate 154 covering a top surface of the inner case 110.

The upper plate 154 may extend horizontally from an upper end of the rear plate 152. Thus, the middle plate 150 may be formed in a shape such as "¬".

The upper plate 154 may be seated on an upper end of the inner case 110. For example, the upper plate 154 may be attached to a top surface portion of the front frame 110 by an adhesive means.

In the state in which the upper plate 154 is seated on the top surface of the front surface of the inner case 110, the upper plate 154 is spaced apart from a top surface of the inner case 110. Thus, the foaming space 159 is defined between the upper plate 154 and the top surface of the inner case 110.

In the rear plate 152 may be coupled to the case supporter 130.

The rear plate 152 may be spaced apart from a rear surface of the inner case 110. Thus, the foaming space 159 is defined between the rear plate 152 and the rear surface of the inner case 110.

A fixing bracket (not shown) may be fixed to the rear side of the rear plate 152, and the fixing bracket may be fixed to each of the side panels 102 and 103. Thus, not only the rear plate 152 is fixed to the side panels 102 and 103, but also deformation of the rear plate 152 during the process of filling the foaming liquid may be prevented.

In a state in which the assembly of the middle plate 150 is completed, a top surface of the upper plate 154 may be disposed lower than the upper end 102*b* of each of the side panels 102 and 103. Thus, a space, in which the cabinet cover 190 is disposed, may be defined above the upper plate 154.

In addition, in a state in which the assembly of the middle plate 150 is completed, the rear surface of the rear plate 152 is disposed to be spaced inward from the rear end of each of the side panels 102 and 103. Thus, there is a space through which air for heat dissipation of the cooling device 50 flows at the rear side of the rear plate 152.

Figure 10:
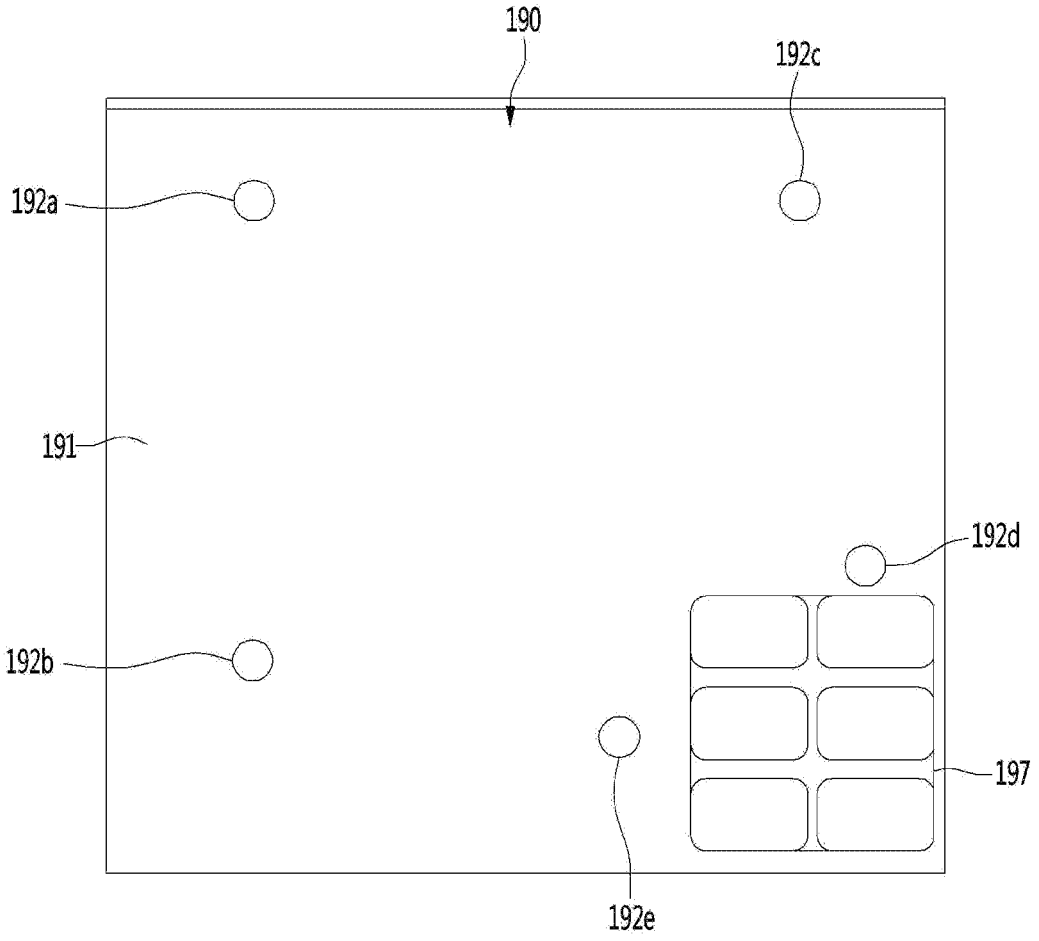
FIG. 10 is a bottom view of a cabinet cover according to an embodiment of the present invention.
Figure 11:
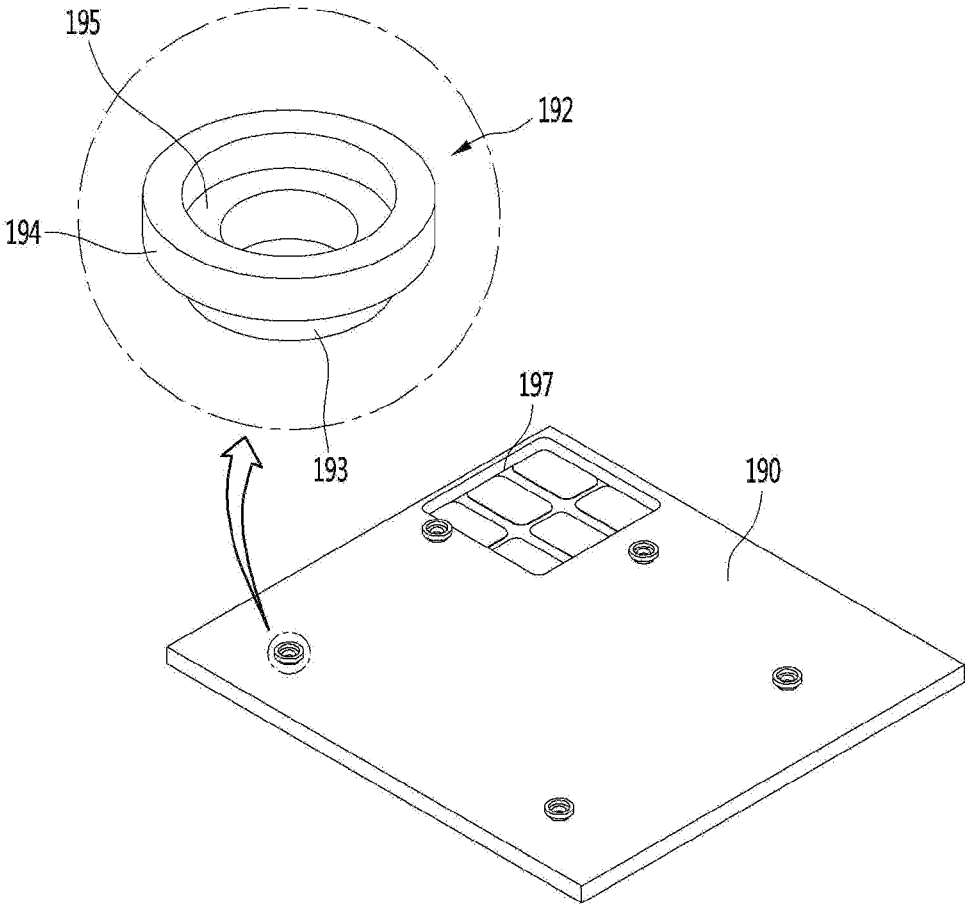
FIG. 11 is a perspective view illustrating a bottom surface of the cabinet cover according to an embodiment of the present invention.

FIG. 10 is a bottom view of the cabinet cover according to an embodiment of the present invention, and FIG. 11 is a perspective view illustrating a bottom surface of the cabinet cover according to an embodiment of the present invention.

Referring to FIGS. 10 to 11, a cover fixing portion 192 for fixing the cabinet cover 190 to the middle plate 150 may be provided on a bottom surface of the cabinet cover 190.

In order to firmly fix the cabinet cover 190 to the middle plate 150, a plurality of cover fixing portions 192 may be provided on the cabinet cover 190.

Each of the plurality of cover fixing portions 192 may be inserted into a groove of the cabinet cover 190 to be coupled to the cabinet cover 190.

That is, the cabinet cover 190 may include a plurality of grooves 192*a* to 192*e* to which the plurality of cover fixing portions 192 are coupled to a bottom surface 191.

In addition, the cabinet cover 190 may further include a charging recessed portion 197 for seating a wireless charging portion (not shown) for wireless charging.

The plurality of grooves 192*a* to 192*e* may be arranged to be spaced apart from each other in the left and right direction and/or the front and rear direction on the bottom surface 191 of the cabinet cover 190.

In detail, referring to FIG. 10, the first groove 192*a* and the third groove 192*c* may be arranged to be spaced apart from each other in the left and right direction on the front surface of the cabinet cover 190, and the first groove 192*a* and the third groove 192*c* may be spaced apart from each other in the front and rear direction.

Here, the charging recessed portion 197 may be disposed on a portion of the rear side of the cabinet cover 190, and a fourth groove 192*d* and a fifth groove 192*e* may be disposed so as not to interfere with the charging recessed portion 197.

In detail, the fourth groove 192*d* may be disposed to be spaced a predetermined interval from the front of the charging recessed portion 197, and the fifth groove 192*e* may be disposed to be spaced a predetermined interval from a side of the charging recessed portion 197.

The positions of the plurality of grooves are only an example, and the positions are not limited thereto, but may be disposed so as not to interfere with the position at which the wireless charging portion is installed.

At least a portion of the plurality of cover fixing portions 192 may be fixedly inserted into the plurality of grooves of the cabinet cover 190.

Since the cabinet cover 190 is made of a stone material, the plurality of cover fixing portions 192 may be fixed to the cabinet cover 190 by an adhesive means such as an adhesive or a tape.

In detail, referring to FIG. 11, each of the cover fixing portions 192 may include a first portion 193 and a second portion 194 having a diameter or a size greater than that of the first portion 193.

In addition, the first portion 193 is disposed between the cabinet cover 190 and the second portion 194, and the first portion 193 is in contact with a bottom surface of the cabinet cover 190.

That is, at least a portion of the first portion 193 may be inserted into the groove of the cabinet cover 190, and the remaining portion may protrude from the bottom surface 191 of the cabinet cover 190 by a predetermined interval.

As a result, the cover fixing portion 192 may be inserted into the cover fixing hole 156 to be described later.

In addition, the cover fixing portion 192 may further include a third portion 195 which is recessed from the second portion 194 toward the first portion 193.

A diameter of the third portion 195 may be the same as or less than that of the first portion 193 and may be less than that of the second portion 194.

Figure 12:
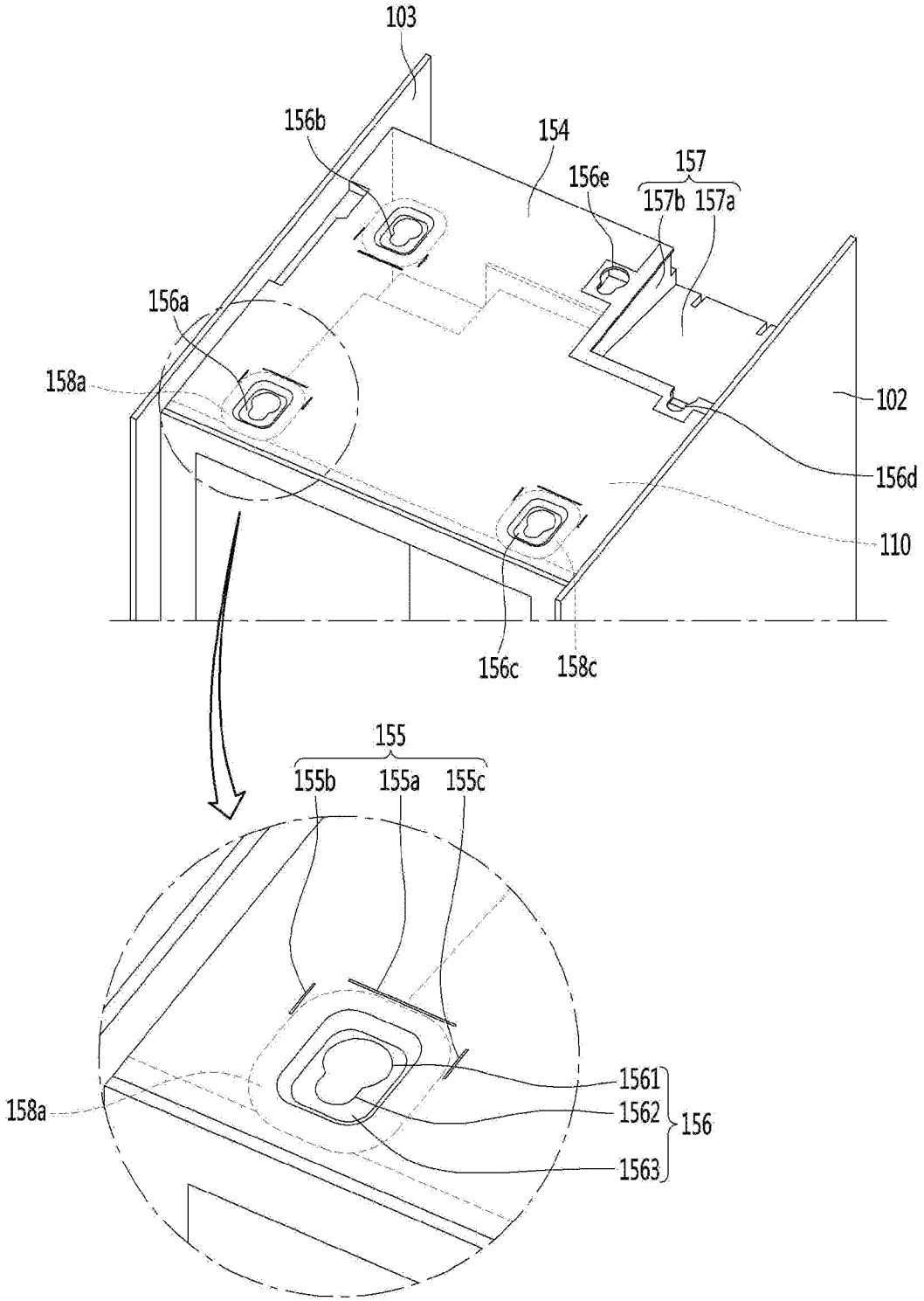
FIG. 12 is a perspective view of the cabinet from which the cabinet cover is removed according to an embodiment of the present invention.
Figure 13:
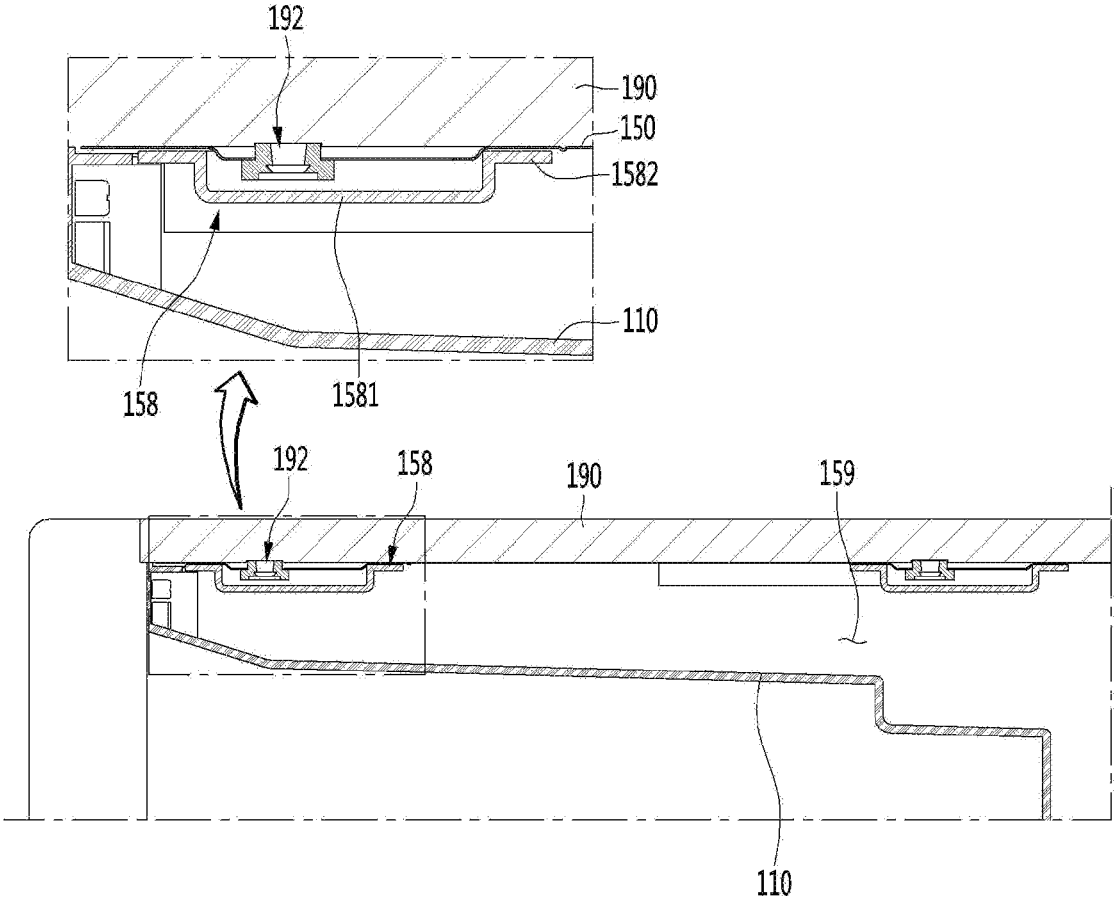
FIG. 13 is a cross-sectional view taken along the line 13-13' of FIG. 1.

FIG. 12 is a perspective view of the cabinet from which the cabinet cover is removed according to an embodiment of the present invention, and FIG. 13 is a cross-sectional view taken along the line 13-13' of FIG. 1.

Referring to FIGS. 12 and 13, the middle plate 150 may include a charging portion 157 in which the wireless charging portion (not shown) for wireless charging is disposed.

The charging portion 157 may be disposed behind the upper plate 154 of the middle plate 150. For example, the charging portion 157 may be formed by being recessed from a rear edge of the middle plate 150.

In detail, the charging portion 157 may include an inclined portion 157*a* spaced a predetermined distance downward from the upper plate 154 and inclined downward toward a rear side and a vertical portion 157*b* connecting the first inclined portion 157*a* to the upper plate 154.

A cover fixing hole 156 for fixing the cover fixing portion 192 may be provided in the middle plate 150. The cover fixing hole 156 may be provided in, for example, the upper plate 154.

In detail, a plurality of cover fixing holes 156 may be provided in plurality to correspond to positions of the plurality of grooves in the cabinet cover 190, and the cover fixing holes 156 may also be disposed so as not to interfere with the charging portion 157 formed on the middle plate 154, like the plurality of grooves.

That is, a first cover fixing hole 156*a* and a second cover fixing hole 156*b* may be disposed to be spaced apart from each other in the front and rear direction on an opposite side of the side surface in which the charging portion 157 is formed, and the first cover fixing hole 156*a* and a third cover fixing hole 156*c* may be disposed to be spaced apart from each other in the left and right directions on the front surface side.

In addition, the fourth cover fixing hole 156*d* may be disposed in front of the charging portion 157, and the fifth cover fixing hole 156*e* may be disposed at a side of the charging portion 157.

That is, the first to fifth cover fixing holes 156*a* to 156*e* may be formed to correspond to positions of the first to fifth grooves 192*a* to 192*e* of the cabinet cover 190.

The charging portion 157 may be formed by injection molding, and in this case, the charging portion 157 may include the fourth cover fixing hole 156*d* and the fifth cover fixing hole 156*e*.

The cover fixing hole 156 may include a first hole 1561 having a size equal to or greater than that of the second portion 194 of the cover fixing portion 192 and a second hole 1562 extending from the first hole 1561 and having a size less than that of the first hole 1561.

In addition, the cover fixing hole 156 may further include a fixing recessed portion 1563 having the first hole 1561 and the second hole 1562, and the fixing recessed portion 1563 may be recessed from the upper plate 154.

The second hole 1562 may be defined to be less than the second portion 194 of the cover fixing portion 192. In addition, the second hole 1562 may have a size that is equal to or greater than that of the first portion 193 of the cover fixing portion 192.

In addition, the middle plate 150 may be provided with a plurality of guide portions 155 for guiding the fixing cover 158 to be described later.

The plurality of guide grooves 155 include a first guide portion 155*a* formed in one surface of the cover fixing hole 156 in the front and rear direction, and a second guide portion 155*b* and a third guide portion 155*c* formed to be spaced apart from both sides of the cover fixing hole 156.

The first guide portion 155*a* may be disposed to be spaced apart from one surface of the fixing recessed portion 1563 of the cover fixing hole 156 in the front and rear direction.

In addition, a length of the first guide portion 155*a* may be greater than that of the front surface of the fixing recessed portion 1563.

In addition, the second guide portion 155*b* and the third guide portion 155*c* may be disposed to be spaced apart from each other with respect to the fixed recessed portion 1563, and a distance between the second guide portion 155*b* and the third guide portion 155*c* may be less than the length of the first guide portion 155*a*.

The fixing cover 158 may be disposed on an area formed by the first to third guide portions 155*a* to 155*c*.

The first to third cover fixing holes 156*a* to 156*c* may include all the configurations of the first hole 1561, the second hole 1562, the fixing recessed portion 1563, and the guide portion 155. However, the fourth to fifth cover fixing holes 156*d* and 156*e* may include only a portion of the above configurations.

This may be because the fourth to fifth cover fixing holes 156*d* and 156*e* are formed by injection molding together with the charging portion 157 and are disposed adjacent to the charging portion 157 formed by being recessed to form the charging portion 157 so as to be affected by the shape of the charging portion 157.

For example, the fourth and fifth cover fixing holes 156*d* and 156*e* may not include the guide portion 155. The guide portion 155 may be configured to guide the position of the fixing cover 158, and in the case of the fourth and fifth cover fixing holes 156*d* and 156*e*, the cover may be molded together during the injection molding of the charging portion 157.

In addition, the fourth cover fixing hole 156*d* may have a form in which a portion of the first hole 1561 is opened. In detail, an opposite portion of the first hole 1561 of the fourth cover fixing hole 156*d* to the portion connected to the second hole 1562 may be opened.

Since the charging portion 157 is formed by being recessed, the charging portion 157 may be recessed when the cover fixing portion 192 is inserted into the first hole 1561 as in the assembly process of the cabinet cover 190 to be described later.

The fourth to fifth cover fixing holes 156*d* and 156*e* are not limited to the above configurations, but the configuration may vary depending on the position, at which the charging portion 157 is installed, and the shape of the charging portion 157.

In addition, a plurality of cover fixing holes 156 may be defined around the charging portion 157 for stable coupling of the cabinet cover 190 and the middle plate 150 including the recessed charging portion 157.

Referring to FIG. 13, the fixing cover 158 may be coupled to the bottom surface of the upper plate 154.

As the foaming liquid is injected into the foaming space 159 defined between the middle plate 150 and the inner case 110 in the fixed cover 158, the foaming liquid may be prevented from leaking by the cover fixing hole 156.

The fixing cover 158 may cover all of the cover fixing holes 156, and for example, a cover recessed portion 1581 surrounding the fixing recessed portion 1563 of the cover fixing hole 156 and the coupling portion 1582 extending from the cover recessed portion.

In detail, the cover recessed portion 1581 may have a plate shape and may be recessed inside the coupling portion 1582.

That is, when the fixing cover 158 is coupled to the middle plate 150, the coupling portion 1582 may be coupled to the bottom surface of the middle plate 150 around the fixing recessed portion 1563. In addition, the cover recessed portion 1581 may be spaced a predetermined distance from the bottom surface of the middle plate 150.

Thus, when the cabinet cover 190 is seated on the middle plate 150, the cabinet fixing portion 192 may be disposed in the space defined by the fixing recessed portion 1563 and the cover recessed portion 1581.

In addition, at least a portion of the coupling portion 1582 may be disposed between the fixed recessed portion 1563 and the guide portion 155.

On the other hand, the fixed cover 158 includes a first fixing cover 158*a* corresponding to the first cover fixing hole 156*a*, a second fixing cover 158*b* corresponding to the second cover fixing hole 156*b*, and a third fixing cover 158*c* corresponding to the third cover fixing hole 156*c*.

The fourth cover fixing hole 156*d* and the fifth cover fixing hole 156*e* may not require a separate fixing cover because the cover is formed together by the injection molding of the charging portion 157, but depending on the configuration, fixing covers corresponding to the fourth cover fixing hole 156*d* and the fifth cover fixing hole 156*e* may be further included.

Figure 14:
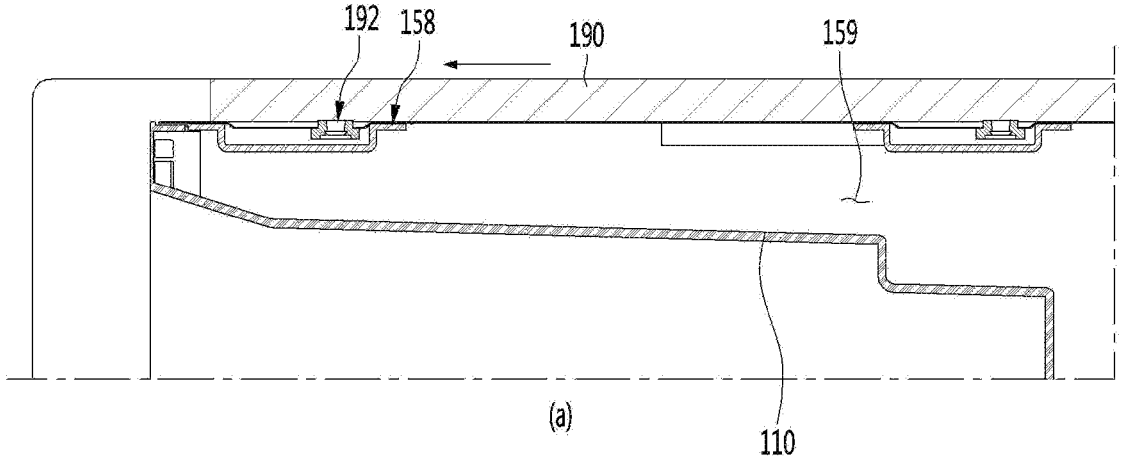
FIG. 14 is a view illustrating a state in which the cabinet cover is coupled to a middle plate according to an embodiment of the present invention.
Figure 14:
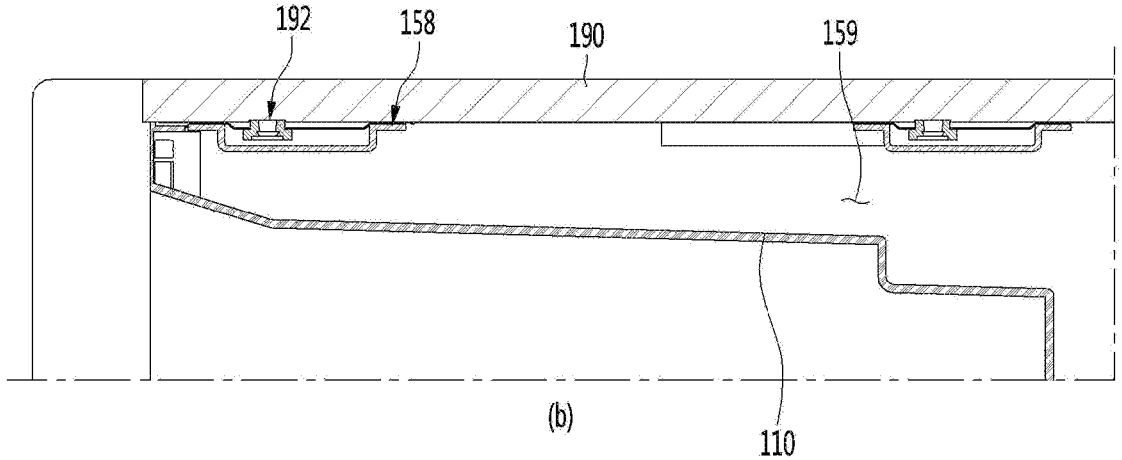

FIG. 14 is a view illustrating a state in which the cabinet cover is coupled to the middle plate according to an embodiment of the present invention.

A process in which the cabinet cover 190 is fixed to the middle plate 150 will be described in detail with reference to FIG. 14.

In order to fix the cover fixing portion 192 to the middle plate 150, the second portion 194 of the cover fixing portion 192 and the first hole 1561 of the cover fixing hole 156 are aligned with each other. Next, the second portion 194 of the cover fixing portion 192 passes through the first hole 1561 of the cover fixing hole 156.

In the state in which the second portion 194 of the cover fixing portion 192 passes through the first hole 1561 of the cover fixing hole 156, the first portion 193 of the cover fixing portion 192 is disposed within the first hole 1561, and the cabinet cover 190 is seated on the upper plate 154.

In this state, the cabinet cover 190 horizontally moves so that the first portion 193 of the cover fixing portion 192 is disposed in the second hole 1562 of the cover fixing hole 156. For example, the cabinet cover 190 may move forward.

That is, in the state in which the cover fixing portion 192 of the cabinet cover 190 is inserted into the first hole 1561 as illustrated in (a) of FIG. 14, the cabinet cover 190 may move forward so that the cover fixing portion 192 is disposed in the second hole 1562 as illustrated in (b) of FIG. 14.

When the first portion 193 of the cover fixing portion 192 is disposed in the second hole 1562 of the cover fixing hole 156, the second portion 194 of the cover fixing portion 196 is in contact with a bottom surface 154 of the upper portion 154.

Thus, the separation of the cabinet cover 190 from the middle plate 150 may be prevented unless the cabinet cover 190 is pushed backward.

In the present invention, since the cabinet cover 190 is coupled to the middle plate 150 in a sliding manner, the cabinet cover 190 may be easily coupled to the middle plate 150 and easily separated from the middle plate 150.

In the present invention, before the cabinet cover 190 is coupled to the middle plate 150, the foaming liquid may be injected into the foaming space 159 in the state in which the cover fixing hole 196 is blocked with the fixing cover 158.

Thus, according to the present invention, there is an advantage that the cabinet cover 190 is capable of being replaced. That is, since the cabinet cover 190 having a design or color desired by the user is coupled to the middle plate 150, there is an advantage that the design of the outer appearance of the refrigerator 1 may be diversified.

In the state in which the assembly of the cabinet cover 190 is completed, the rear end of the cabinet cover 190 is disposed inside the rear end of each of the side panels 102 and 103. Therefore, there is a space, in which the display unit 60 is disposed, at the rear side of the cabinet cover 190.

What is claimed is:

1. A refrigerator comprising:

a cabinet to provide a storage space; and a door configured to open and close the storage space, wherein the door includes:

a front panel having a rear surface, and a guide groove is provided at the rear surface;

a door liner disposed on the rear surface of the front panel to define a first foaming space between the door liner and the front panel; and an insulating material to be provided in the first foaming space, wherein the door liner includes:

a panel coupling portion that is in contact with the rear surface of the front panel, and a portion of the panel coupling portion is inserted into the guide groove, a cabinet inlet protruded from the panel coupling portion in a direction away from the front panel, and a fixing portion configured to contact a portion of a bottom surface of the front panel, wherein the fixing portion extends from a surface of the cabinet inlet toward the front panel.

2. The refrigerator according to claim 1, wherein the front panel and the door liner are fixed by the insulating material.

3. The refrigerator according to claim 1, wherein the panel coupling portion includes an insertion portion that extends toward the front panel, and the insertion portion is inserted into the guide groove.

4. The refrigerator according to claim 1, wherein the fixing portion to contact a portion of a circumference of the front panel.

5. The refrigerator according to claim 1, wherein the cabinet includes:

an inner case configured to define the storage space;

first and second side panels disposed at sides of the inner case;

a middle plate disposed between the first and second side panels to define a second foaming space between the middle plate and the inner case; and a cabinet cover on a top surface of the middle plate.

6. The refrigerator according to claim 5, wherein a plurality of cover fixing portions are provided on a bottom surface of the cabinet cover, and a cover fixing hole is disposed at the top surface of the middle plate, and one of the cover fixing portions is disposed to correspond to the cover fixing hole.

7. The refrigerator according to claim 6, wherein the cover fixing portion includes:

a first portion to be inserted into the cabinet cover; and a second portion coupled to the first portion and having a diameter greater than a diameter of the first portion.

8. The refrigerator according to claim 7, wherein the cover fixing hole includes:

a first hole having a diameter equal to or greater than the diameter of the second portion of the cover fixing portion; and a second hole extending from the first hole and having a diameter less than the diameter of the first hole.

9. The refrigerator according to claim 8, wherein a size of the second hole is less a size of the second portion, and the size of the second hole is greater than a size of the first portion.

10. The refrigerator according to claim 6, wherein the cabinet includes a fixing cover to couple to a bottom surface of the middle plate, and the fixing cover is configured to cover the cover fixing hole of the middle plate.

11. The refrigerator according to claim 10, wherein the fixing cover includes:

a cover recess portion spaced apart from the cover fixing hole on the bottom surface of the middle plate; and a coupling portion configured to connect the cover recess portion to the middle plate and to contact the bottom surface of the middle plate.

12. The refrigerator according to claim 11, wherein the middle plate includes a plurality of guide portions disposed to be spaced apart from each other on at least one surface of the cover fixing hole and recessed into the middle plate, and the coupling portion is disposed between the guide groove and the cover fixing hole.

13. The refrigerator according to claim 1, wherein the cabinet includes:

a rear panel that includes an external air suction hole; and a rear cover configured to cover the external air suction hole, and the rear cover includes a plurality of holes.

14. The refrigerator according to claim 13, wherein the rear cover includes a cover plate to be spaced apart from the rear panel, and a plurality of holes disposed on the cover plate to correspond to the external air suction hole of the rear panel.

15. The refrigerator according to claim 14, wherein the rear cover includes a side surface portion configured to connect the cover plate to the rear panel, and the side surface portion includes a plurality of holes on the side surface portion.

16. The refrigerator according to claim 13, wherein the cabinet comprises a base configured to define an outer appearance of a lower portion of the cabinet, and the base includes a protrusion that protrudes from a rear surface of the base, and the rear cover is to be disposed on a top surface of the protrusion.

17. A refrigerator comprising:

a cabinet to provide a storage space; and a door configured to open and close the storage space, wherein the door includes:

a front panel having a surface, a door liner disposed on the surface of the front panel to define a first foaming space between the door liner and the front panel, and an insulating material to be provided in the first foaming space, wherein a portion of the door liner is in contact with a portion of the surface of the front panel, wherein the cabinet includes:

an inner case configured to define the storage space, first and second side panels disposed at sides of the inner case, a middle plate disposed between the first and second side panels to define a second foaming space between the middle plate and the inner case; and a cabinet cover on a top surface of the middle plate.

18. The refrigerator according to claim 17, wherein the cabinet cover includes a plurality of cover fixing portions on the cabinet cover, and the middle plate includes a cover fixing hole, and one of the cover fixing portions is disposed to correspond to the cover fixing hole, wherein the cabinet includes a fixing cover to couple to a surface of the middle plate, and the fixing cover is configured to cover the cover fixing hole.

* * * * *